United States Patent [19]

Ladrick

[11] 4,055,845

[45] Oct. 25, 1977

[54] ANTENNA ERECTING SYSTEM

[76] Inventor: Ray C. Ladrick, 961 Lornaberry Lane, Columbus, Ohio 43213

[21] Appl. No.: 696,033

[22] Filed: June 14, 1976

[51] Int. Cl.[2] ..... H01Q 1/32; H01Q 3/00

[52] U.S. Cl. ..... 343/715; 343/760; 343/882

[58] Field of Search ..... 343/881, 709, 766, 903; 64/30 R

[56] References Cited

U.S. PATENT DOCUMENTS

| | | | |
|---|---|---|---|
| 2,565,334 | 8/1951 | Weingarden | 343/766 |
| 3,157,978 | 11/1964 | McMullen | 64/30 R |
| 3,417,523 | 12/1968 | Matson | 343/881 |
| 3,896,447 | 7/1975 | Majkrezak | 343/709 |

*Primary Examiner*—Alfred E. Smith
*Assistant Examiner*—Harry Barlow
*Attorney, Agent, or Firm*—Sidney W. Millard

[57] ABSTRACT

Apparatus for automatically erecting a vehicle mounted antenna of the type utilized for citizens band radios. A p.m. motor provides drive to pivotally move the antenna and a logic circuit comprising only a double-pole-double-throw and two secondary switches provides fully automatic performance in conjunction with turning on the radio. LEDs are selectively illuminated to show antenna status by utilizing a circuit logic path incorporating the winding of the motor. A friction coupling override arrangement protects the erecting mechanism while retaining drive logic.

10 Claims, 7 Drawing Figures

ANTENNA ERECTING SYSTEM

BACKGROUND

Over the relatively recent past, the marketplace has witnessed a considerable consumer interest in citizens band (CB) radios suited for use in both pleasure and commerical vehicles. For adequate performance, these radios require an antenna of relatively elongate configuration, (i.e. from 2 to 9 feet in length) which is mounted upon an external surface of the vehicle. For more improved or optimised radio performance the aerials or antennae preferably are mounted at a higher position on the vehicle, for example, upon the roof or upward side portion of an automobile or truck to achieve a directional pattern that is roughly an oval. Additionally, inasmuch as the larger antenna (9 feet) represents an even fraction of a 27-$MH_z$ Citizens Band (CB) wave, its efficiency and the consequent desirability of its use becomes apparent.

However, when so mounted for optimised reception and transmission, the antennae, the longer of which are referred to as "whip antennas," extend a considerable distance above the roadway. So positioned they are in jeopardy of striking overhead elements such as trees, overhead bridge structures, building entrance ways and the like which are typically encountered in day-to-day driving. One approach to avoiding these potentially damaging obstructions is to mount the antenna at a lower position on the vehicle. However such safer mounting positions will engender less desirable radio performance. Techniques have been proposed in the past for automatically or semi-automatically selectively elevating or lowering vehicle mounted antennae. For instance, reference is made to U.S. Pat. Nos. 3,143,646; 2,949,608 and 2,933,597 wherein automobile mounted antennae are driven by an electric motor to an operational position upon the switching on of a radio mounted within the passenger compartment thereof. Generally, these approaches to antenna elevation are concerned with more conventional antenna structures of a telescoping variety. To derive the logic necessary to provide energization of the antenna drive motor both during and subsequent to the switching on of power to the radio, the patents look exclusively to that circuit logic which is available through the use of electro-magnetic relays, for instance solenoid actuated switches and the like. Disadvantage accrues with the use of such components and logic, particularly, by virtue of the necessary complexity of the resultant elevating device and consequent cost to the consumer. Further, such techniques for achieving a desired automatic elevation of the antennae do not provide for a desirable apprisal of the vehicle operator of the status of such elevation. For instance, it is desirable that some perceptive warning be available to the operator indicating that an antenna is in its fully elevated and, consequently, vulnerable orientation. Additionally, it is desirable that the operator have some positive indication that the antenna is in an appropriately secure location or orientation. In addition to such features, it is desirable that an automatic logic be incorporated with the antenna elevation scheme such that only one manual manipulation, the throwing of a single switch, serves to elevate the antenna automatically while energizing the vehicle mounted radio. Similarly, it is desirable that the antenna automatically be retracted upon turning off energy to the radio.

It reasonably may be anticipated that in the course of normal vehicle usage the operationally oriented antennae will sometimes strike overhead objects. On such occurences, it is important to minimize damage both to the antenna rod structure as well as to the mounting components from which it is supported. Accordingly, some form of override is desirable to permit movement of the antenna from its operational orientation without damage upon inadvertent encounters with overhead objects. Assuming such mounting features can be incorporated within the antenna support arrangement, it is further desirable that the elevating logic of the antenna erecting system be capable of automatically restoring a thus displaced antenna to its original operating position. With such an arrangement, slight displacements which may be caused by minor collisions in the course of driving would be automatically accommodated for by the antenna position control logic. Of course, such logic must be incorporated in a manner wherein the erecting device is fabricable utilizing high volume fabrication techniques suited to achieve those reasonable costs required in the consumer market.

SUMMARY

The present invention is addressed to an improved system and apparatus for automatically driving or erecting a communications component such as an antenna between initial or secured and operational orientations.

Ideally suited for use in conjunction with motor vehicles, the system operates to automatically drive a vehicle mounted antenna from a secured position to an operational orientation upon the manual actuation of a switch. This switch also may serve to energize a radio arrangement mounted within the passenger compartment of the vehicle. Upon throwing the noted switch to an opposite position, the radio is de-energized and the antenna is automatically driven to its original secured orientation.

A particularly important aspect of the invention resides in the provision of the noted drive or erection logic for the antenna without the utilization of cost contributing and complex electromagnetic relays and the like. For instance, the highly efficient circuit utilizes two relatively simple switches at the point of antenna drive and mounting in combination with a singular double pole switch at the point of utilization. No other logic components are required and, accordingly, the system and apparatus is ideally suited for use within a broad commercial market.

Another feature and object of the invention is to provide, within the noted system and apparatus for manipulating a vehicle mounted antenna between secured and/or operational orientations, a feature providing a visually perceptible indicator arrangement which is energized only at such time as the antenna is elevated to its fully operational orientation. Similarly, a visually perceptible indicator arrangement is provided which is energized to apprise the operator that the antenna is at its secured orientation. A third visual indication is provided by the system for apprising the operator that power is supplied to the vehicle mounted radio.

The logic for providing energization of the noted indicators, in compliment with the unique simplicity of the drive logic, itself utilizes only conventional light emitting diodes (LED's) in combination with an impedance arrangement selected for current limiting purposes. To achieve an indicator logic wherein one indicator or LED is energized only when the antenna reaches its fully operational orientation, a circuit path is provided which includes the noted double pole switch at the point of operator control and the winding of the p.m. motor driving the antenna between its dual orientations. By incorporating the circuit limiting impedance or resistance with each diode, the quantum of current passing through the motor winding is so low as to prevent the conversion thereof to mechanical energy or to engender any damage to the motor. Similarly, a light emitting diode (LED) is provided in combination with a current limiting impedance arrangement and circuit path to achieve illumination of the diode when the antenna is in its nested or secured position. This is provided through a circuit path that includes the noted motor winding as well as the double pole switch, the latter switch being in an opposite orientation as described in the former case for the antenna being in an operational orientation.

Another feature and aspect of the invention provides for a mounting arrangement for the noted antenna in combination with the drive motor with an intercoupling therebetween permitting the accommodation of the system to extraneous forces exerted upon the antenna by accident or otherwise. With the arrangement, a friction coupling is inserted between the antenna drive and the motor driving input thereto. As a foreign object is struck by the antenna or vice-versa, the friction coupling permits the antenna to move with respect to its drive input to accommodate the extraneous forces without damage thereto. An advantageous feature of this arrangement resides in the positioning of the earlier noted initial switch arrangement in combination with the movement of the antenna itself. With such arrangement of these switches or their actuator, externally applied force to the antenna will alter the switching sense thereof to permit the antenna automatically to be driven to return to its operational orientation. In similar respect, should the antenna be forced out of its secured position, the switching logic will return it into its properly secured position.

Other objects of the invention will, in part, be obvious and will, in part, appear hereinafter.

The invention, accordingly, comprises the system and apparatus possessing the construction, combination of elements and arrangement of parts which are exemplified in the following detailed disclosure.

For a fuller understanding of the nature and of the invention, reference should be had to the following detailed description taken in conjunction with the accompanying drawings.

DETAILED DESCRIPTION

As described hereinabove, the automatic antenna positioning arrangement of the invention is particularly suited for operation with the conventional aerials utilized in conjunction with citizen's band radios and the like. In consequence of the automatic correction features as well as antenna protective override arrangements of the invention, such antennae may be installed, for instance, at optimized locations upon a vehicle, i.e. the roof or other point of higher elevation.

Figure 1:
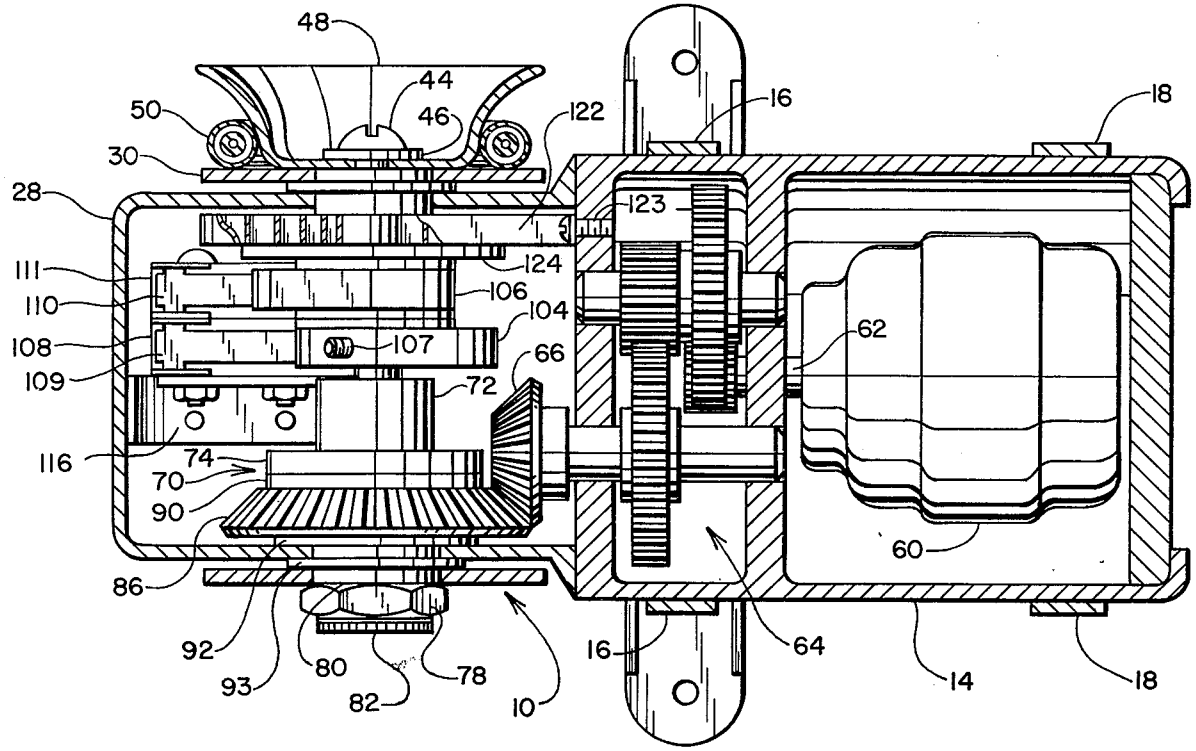
FIG. 1 is a top view of a housing incorporating drive components of the apparatus of the invention with portions broken away to reveal the internal structure.
Figure 3:
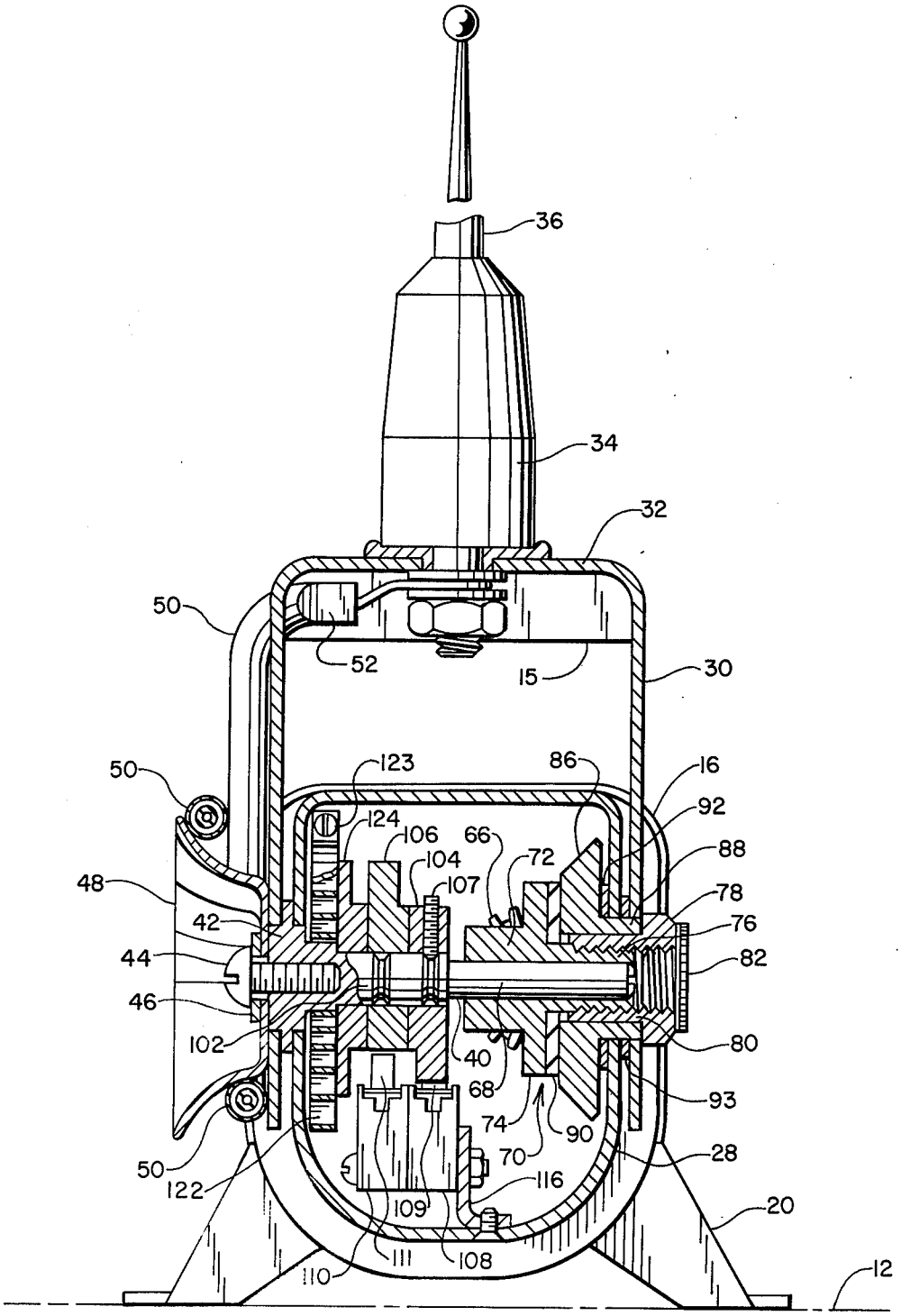
FIG. 3 is a partial sectional view of the apparatus of FIG. 1 taken along a plane transverse thereto.

Looking to FIGS. 1 and 3, top and sectional views of the erecting mechanism are revealed. The erecting mechanism as revealed generally at 10, is mounted, for instance, on the roof of a vehicle, represented only schematically by the plane 12. Mechanism 10 includes a housing portion 14 including a top 15, the combination of which is retained in position by encircling straps as at 16 and 18. Straps 16 and 18, in turn, are affixed to the roof or vehicle surface 12 by respective connectors one of which is revealed at 20. Connectors as at 20 are shown only generally, it being understood that they may be of a variety providing for screw-type attachment, as with sheet metal screws, to the surface 12, or they may be of a non-destructive variety such as resilient suction devices common in the market, or other convenient attachments intended for simplified mounting.

Extending from the housing 14 is a drive component mounting portion 28, which is revealed in more detail in FIG. 3. Pivotally mounted upon drive component mounting portion 28 is a generally U-shaped bracket 30, the upwardly disposed or closed surface 32 is of flat shape suited for mounting an antenna assemblage comprising a base mount 34 and an antenna rod extending and supported therefrom, as at 36. Bracket 30 and antenna 36 are shown in orientations wherein the antenna 36 extends upwardly in its operational position.

Looking particularly to FIG. 3, the pivotal mounting arrangement for bracket 30 upon drive component mount 28 is revealed. As shown in the latter figure, bracket 30 is journaled over and fixed to a cylindrically shaped drive shaft 40 at a shoulder portion thereof 42. Connection at that side shaft 40 is provided by a truss head screw 44 which extends into a tapped recess formed centrally therewithin and is arranged for tightening against a lock washer 46 and a bell shaped antenna cable guide 48. As is revealed in FIG. 3, the cable, extending from antenna 36 exits from bracket 30 at 52 and is loosely wound about cable guide 48 for purposes of accommodating the pivotal action of bracket 30 and associated antenna 36 in the course of movement between the operational position shown and a secured or storage orientation. This arrangement enhances the life span of the cable 50 by minimizing the fatigue stresses otherwise generated therein in the normal course of operation of the system. Of course, cable 50 extends to an appropriate output of the corresponding radio component.

FIG. 1 also reveals an electric motor 60 having an output shaft 62 coupled in driving relationship with a reduction gear train represented generally at 64.

Mounted within housing 14, motor 60 is of a p.m. variety operative to provide a drive of one rotational sense at shaft 62 in dependence upon the polar sense of the current applied thereto i.e. the direction of rotation is reversable in dependence upon the direction of current through the winding thereof. Reduction gear train 64 is selected to modify the output of motor 60 in accordance with the power required for pivoting bracket 30 and associated antenna 36 as well as for providing the desired speed of movement of the bracket between its secured and operational orientations. The output of the reduction gear train 64 is present at a bevel gear 66, more clearly revealed in FIG. 3. Looking to that figure, drive shaft 40 is seen to be formed having a necked-down portion 68 which extends into a friction coupling revealed generally at 70. Coupling 70 extends in slidable or pivotal supporting relationship with one side of component mounting portion 28 and, additionally, through one side of bracket 30. This extension will be seen to be arranged to provide a pivotal support of bracket 30 upon portion 28. Coupling 70 comprises a clutch member 72 of generally cylindrical configuration, the centrally disposed bore of which is journaled over and fixedly keyed to necked down portion 68 of drive shaft 40. Clutch member 72, thus fixed to shaft portion 68, has a flange portion 74 formed integrally with a tubular shaped stem portion 76 extending to the inwardly facing surface of one side of bracket 30. The outward surface of stem portion 76 is threaded as revealed in FIG. 3. Extending in journaled fashion over stem portion 76 is a cylindrically shaped clutch tension nut 78 having a shoulder portion 80 positioned outwardly of the external surface of bracket 30. The cylindrical inward surface of tension nut 78 is threadedly engaged with the corresponding threads of stem portion 76 and is closed by engagement with a cap screw 82. Positioned over the elongate stem portion of clutch tension nut 78 is a beveled main gear 86 engaged with bevel gear 66 and formed having a cylindrical shoulder portion 88 extending through a side of bracket 30 and abutting against the inwardly disposed surface of shoulder portion 80 of tension nut 78. The inwardly facing surface of gear 86, normal to drive shaft portion 68, is configured for frictional and slidable engagement with a ring shaped friction pad 90, while the oppositely facing surface thereof is spaced from the inward surface of mounting portion 28 by a fiber washer as at 92. A washer 93 is positioned between portion 28 and bracket 30.

With the arrangement thus provided, friction coupling 70 operates to translate rotative drive force from main gear 86 through friction pad 90 and to the flange portion 74 of clutch 72. Clutch 72, in turn, transmits this rotational drive to necked down portion 68 of drive shaft 40. Rotation of tension nut 78 serves to adjust the amount of relative pressure intermediate flange portion 74 and gear 86 exert against intermediately disposed friction pad 90. With the arrangement, a selective override feature is provided. For instance, should external force be applied to the antenna portion 36 of bracket 30 the coupling 70 permits a relative motion between flange 74 and gear 86. Note that the shaft 40 will rotate, however, in correspondence with any overriding motion of bracket 30 and antenna 36. It further may be noted that the drive shaft 40 is supported by the friction coupling incorporating drive or main gear 86 as it extends through an aperture formed in one side of bracket 30. The journaled connection at that point is one slidable in nature as well as the journaled association between the corresponding side of portion 28 and shoulder portion 88 of the drive gear. Power to gear 86 is provided by the earlier described worm gear 66 extending from reduction gear train 64 (FIG. 1) the teeth of which are enmeshed with corresponding teeth in the beveled portion of gear 86.

Figure 2:
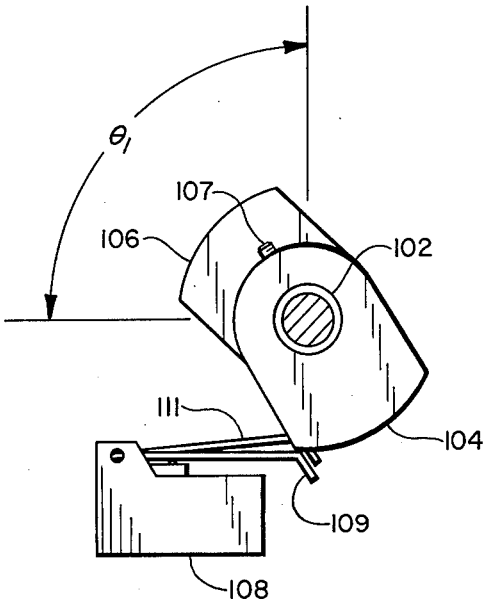
FIG. 2 is a partial side sectional view of the housing of FIG. 1 showing components within the apparatus thereof with the antenna in an operational orientation.

Referring to FIGS. 1–3, the switching and counter-balancing features of the assembly are revealed. In this regard, a second stepdown portion 102 of drive shaft 40 is configured to support a switch actuator arrangement present as cams 104 and 106 which are fixed thereto by tap screws, one of which is revealed at 107. Positioned in operational relationship with cams 104 and 106 are respective single-pole single-throw micro-switches 108 and 110. Mounted in banked fashion by bolts and nuts extending therethrough and in attachment with a bracket 116 fixed, in turn, to a lower portion of housing portion 28, switches 108 and 110 contribute to the position and signalling control logic of the system. Preferably, both switches are of a "snap-action" variety and are biased to assume one particular circuit orientation, for instance in the embodiment to be described in detail, they are normally closed. Typically, switches 108 and 110 are formed incorporating actuator levers, shown respectively at 109 and 111. These levers, when driven by respective cams 104 and 106, will, in turn, actuate an appropriate switch actuator button. By incorporating the levers, required tolerances between an associated switch and cam profile are eased.

It may be observed that FIGS. 2 and 3, each revealing an operational or "up" orientation of bracket 30 and antenna 36, show that switch 108 has been tripped by associated cam 104 to assume an open circuit orientation. As is apparent, as the appropriate rising profile portion of cam 104 contacts in sliding fashion the actuator lever 109 of switch 108, bracket 30 and antenna 36 will have closely approached and achieved the noted up or operational orientation. At such time as the snap action switch 108 opens, drive to the system from motor 60 is halted. Correspondingly, just following a reversal of motor drive, cam 104 will leave contact with the actuator lever 109 of switch 108 to permit the switch to rapidly resume its normally closed circuit orientation. In FIG. 2, the angular orientation of bracket 3 and antenna 36 with respect to the plane 12 is depicted as angle $\theta_1$.

Figure 4:
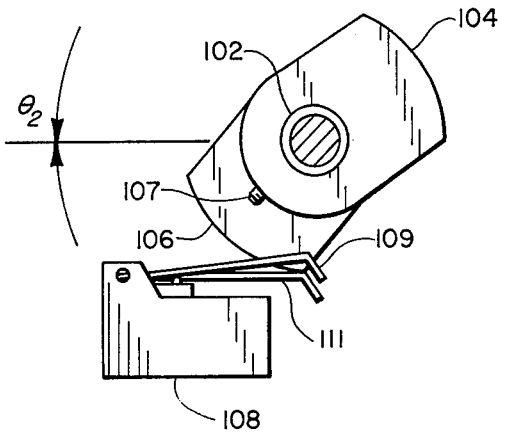
FIG. 4 is a side sectional view of the apparatus similar to FIG. 2 but showing the orientation of components when the antenna supported thereby is in a secured orientation.

Looking momentarily to FIG. 4, the relative associations of these switching components are revealed when antenna 36 and bracket 30 have been driven by motor 60 to a secured or "down" orientation. The angle of bracket 30 with respect to plane 12 now is designated, $\theta_2$ and may be observed to be 0°. Note in the figure, that the rising profile portion of cam 106 now has contacted the actuator lever 111 of snap action micro-switch 110 and has caused the switch to assume an open circuit orientation. As before, upon the initiation of motor drive to move antenna 36 upwardly or into an operational orientation, the rising profile of cam 106 will fall from actuator lever 111 of switch 110 to permit it to rapidly assume its normally closed circuit configuration.

Looking to FIGS. 1–4, a counter-balancing spring 122 is revealed. Retained in positional alignment by a collar 124, spring 122 is of a spiral variety wound about an inwardly disposed step portion of drive shaft 40, one end of the spring being fixed thereto, while the outwardly disposed end is fixed with housing 14 by screw 123. Thus connected within the device, spring 122 is wound or tensioned as bracket 30 and attached shaft 40 are pivoted to the down or secured orientation of FIG. 4. Accordingly, upon energization of motor 60 to drive the antenna 36 and bracket 30 to the up or operational orientation, spring 122 exerts a counterbalancing force to equalize the load imposed by the weight and inertial aspects additionally asserted from antenna 36.

Figure 5:
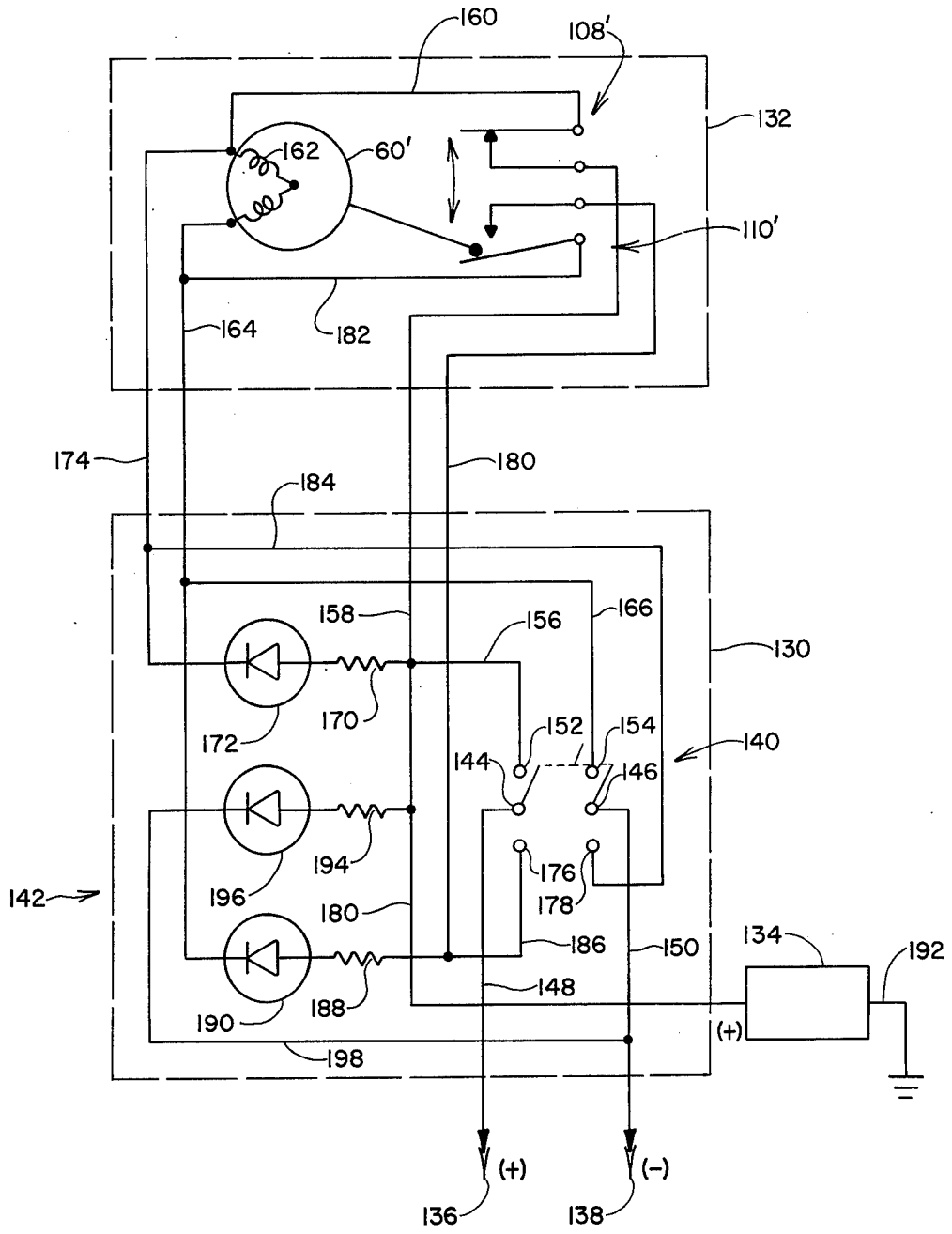
FIG. 5 is a schematic circuit diagram of the control for the system of the invention.

Referring to FIG. 5, the circuit component deriving the control logic for the system of the invention is revealed in schematic form. Those circuit components which are intended to be mounted at a convenient location, for instance, within a motor vehicle, are shown surrounded by a dashed boundary 130; while those incorporated with the drive assembly described hereinabove are shown surrounded by dashed boundary 132. For purposes of consistency, switches 108 and 110 are schematically represented in the drawing respectively at 108' and 110', while motor 60 is revealed in the figure at 60'. The vehicle-mounted portion of the radio equipment, for instance a citizen's band (C.B.) radio, is represented by block 134, while the source of electrical power as derived, for instance through the ignition and/or battery of the vehicle, is shown availed at terminals 136 and 138.

Components within boundary 130 perferably are situated within a small auxillary housing which may be attached at some convenient location within the vehicle and include a manually actuable switch arrangement, revealed generally at 140 and a visible or perceptable indicator arrangement revealed generally at 142. Looking initially to the switching features of the system, switch 140 is present as a double-pole double-throw switch having power input terminals 144 and 146 coupled, respectively, through lines 148 and 150 to respective power source terminals 136 and 138.

To provide an antenna elevating or operational orientation logic, the common throw of switch 140 is actuated to provide the mutual contact of terminal 144 with terminal 152 and terminal 146 with terminal 154. Assuming that antenna 36 is in a secured orientation or "down," the contacts of switch 110' will represent an open circuit orientation as shown. With the circuit path thus defined, power is applied from switch terminal 144 through terminal 152 and lines 156 and 158 to the normally closed contacts of switch 108'. From switch 108', current is permitted to pass through line 160 and the winding 162 of motor 60' to line 164. Line 164, in turn, is coupled through line 166 to switch terminal 154, the switch contact and terminal 146 as well as line 150 to power source input 138. Motor 60' thus is energized in one polar sense to drive antenna 36 into an operational or up orientation. Turning momentarily to FIGS. 2 and 3, as the "up" operational orientation is closely approached and/or reached, cam 104 serves to trip switch 108 thereby causing it to rapidly assume an open circuit orientation. In consequence, power of magnitude sufficient to sustain motor drive is terminated to halt bracket 30 and attached antenna 36 in the noted operational orientation. However, another circuit path is completed. Power now is asserted from switch 140 through line 156, a current limiting resistor 170 and a light emitting diode (LED) 172 to line 174. Line 174, in turn, extends through a path including winding 162 of p.m. motor 60' as well as line 164 leading, as before, through terminal 154 of switch 140 and to source input 138 through line 150. Accordingly, LED 172 is energized to provide a perceptible indication that antenna 36 is fully erected. Resistor 170 is inserted within the noted circuit path to limit the amount of current permitted to pass through winding 162 to a trickle level to avoid actuation of motor 60' as well as any deleterious influence upon its winding and associated drive components.

To effect the driving of antenna 36 into its secured or down position, switch 140 is thrown to provide contact between terminals 144 and 146 with respective contact terminals 176 and 178. The thus altered circuit path "open-circuits" the earlier described path illuminating LED 172 and provides a power input of a different polar sense from terminal 144 through switch contact terminal 176 and lines 186 and 180 through the normally closed contacts of switch 110'. From switch 110', current is permitted to pass through lines 182 and 164 to winding 162. However, the polar sense of the thus introduced current to motor 60' serves to drive its output in a reverse rotational sense to commence to move bracket 30 and antenna 36 toward their secured orientation. The circuit is completed from winding 162 through lines 174 and 184, terminals 178 and 146 of switch 140 and line 150 to source input 138. Looking additionally to FIGS. 3 and 4, as bracket 30 and antenna 36 closely approach and/or reach a fully secured or down orientation, the rising profile portion of cam 106 contacts the actuator lever 111 of microswitch 110 to cause the latter to assume an open circuit orientation. At such time, the power input to motor 60' and winding 162 is substantially terminated to, in turn, halt the rotational output of the motor. However, a circuit path now is completed which includes switching terminal 176, line 186, a current limiting resistor 188 and an indicating LED 190. The cathode side of LED 190 is coupled through line 164 to winding 162 of motor 60'. Further, the path traverses through lines 174, 184 and terminal 178 of switch 140 to extend through terminal 146 and line 150 to source input 138. As before, however, the value of resistor 188 is selected such as to permit illumination or energization of LED 190 while holding the current passing through winding 162 to a trickle level preventing motor actuation or damage to the winding. The operator then has a visual perceptive indication that the antenna is in a secure or safe orientation.

Another feature of the invention provides for a simultaneous energization of radio equipment 134 with the actuation switch 140 to the above-described orientation providing for elevating antenna 36. In this regard, line 158 is seen to extend to radio equipment 134, which, in turn, is coupled to ground through line 192. Additionally, upon such actuation of switch 140, power supplied through line 158 and a path including current limiting resistor 194, light emitting diode (LED) 196 and line 198 to line 150. Accordingly, whenever radio equipment 134 is energized, a visual indication is provided through the energization of LED 196.

From the foregoing it may be observed that the entire drive logic for the inventive system is provided by two single-pole single-throw switches positioned at the antenna drive component housing portion, as revealed within dashed boundary 132, and a double-pole double-throw switch, contained within the motor vehicle, as represented within dashed boundary 130. No extraneous logic devices such as solenoids or electromagnetically driven switches and the like are required to achieve full operational logic. Additionally, no complex circuitry is required to achieve the perceptible indication of antenna position status, inasmuch as LED's 172 and 190, operating in conjunction with the switch arrangement, utilize circuit paths incorporating motor winding 162. Significant economy as well as improved logic performance is realized through these arrangements.

Figure 6:
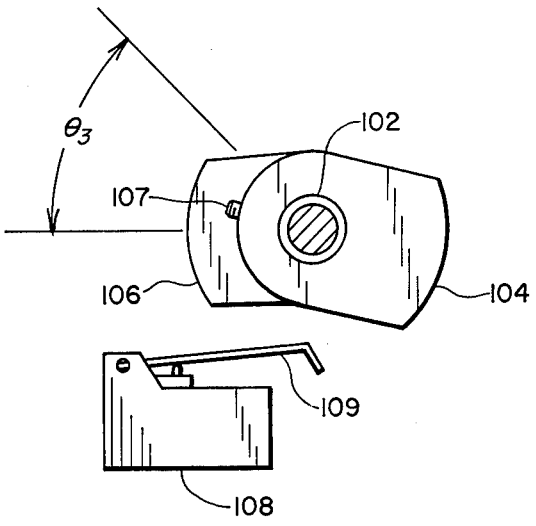
FIG. 6 is a partial sectional view of the vehicle mounted apparatus of the system in an orientation wherein the antenna supported thereby is intermediately oriented between its operational and secured positions.

Another advantage is achieved with the arrangement of the invention, for instance, when antenna 36 strikes or is moved by some foreign object encountered in the operation of the motor vehicle upon which it is mounted. Looking additionally to FIG. 6, an orientation of the switching components are revealed following such an occasion. Here, with antenna 36 partially "down" or tilted with respect to the plane of surface 12, the angle subtended therebetween becomes, $\theta_3$. For illustrative purposes, angle, $\theta_3$, is shown as about 45°. As described earlier in conjunction with FIG. 3, drive shaft 40 including switch actuator cams 104 and 106 are fixedly related to bracket 30 and to antenna 36. Accordingly, with forced movement of antenna 36 by a foreign object, friction coupling 70 will be overridden by virtue of the rotation of shaft 40. Inasmuch as cams 104 and 106 move with the shaft, and assuming that switch 140 is in a circuit completing orientation providing for an erected or operational orientation for antenna 36, the circuit path providing for the energization of motor 60' will be provided. As a result, winding 162 of motor 60' is again energized in an appropriate sense to return bracket 30 and attached antenna 36 to an operational orientation without requiring any action on the part of the operator. Note however, that the operator will be apprised of the condition of antenna 36 by virtue of the de-energization of LED 172 at such time as the displacement occurs. For instance, inasmuch as switch 108' is closed, LED 172 becomes isolated. In similar fashion, should antenna 36 be displaced from its secured position by some unanticipated externally derived force, switching logic will automatically obtain for energizing motor 60' to return the antenna to its properly secured orientation, assuming that switch 140 is in a position commanding such secured orientation. Upon such displacement, switch 110' will reassume its normally closed orientation and, during the energization of winding 162, LED 190 is back-biased.

To provide optimised operation of the device, counter-balancing spring 122 may be adjusted through the simple expediant of loosening screw 44 and, optionally, the pressure at clutch or friction coupling 70. Following this procedure, drive shaft 40 is manually rotated to add turns to spring 122. Of course, before retightening the assembly, the cams as at 104 and 106 must be realigned.

Figure 7:
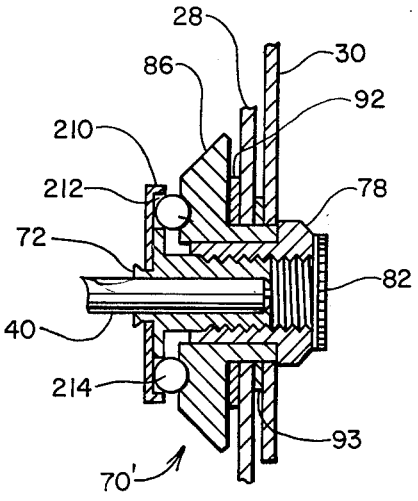
FIG. 7 is a partial view of an alternate form of friction coupling which may be utilized with the drive component embodiments of the earlier figures.

Referring to FIG. 7, another arrangement for a friction coupling is revealed at 70'. In this embodiment, coupling 70' is formed incorporating an annular flange portion 210 extending from clutch member 72. A disk-type flat spring 212 is staked to an outer extension of flange portion 72 and is configured to urge a plurality of steel balls, as at 214, inwardly from the apertures within which they are nested within flange portion 210. The outer surface of gear 86 is hemispherically indented in regularly spaced fashion such that a ratchet-type friction coupling is provided. Accordingly, overriding motion imparted from bracket 30 will cause the balls, as at 214, to slip along the ratchet-type periphery of gear 86 to permit relative motion between that gear and the bracket 30 drive. Further, a noise of ratchet derivation will be heard upon any overriding of bracket 30 to provide audible perception for the operator that an override condition has occurred.

Since certain changes may be made in the above apparatus without departing from the scope of the invention herein involved, it is intended that all matter contained in the above description or shown in the accompanying drawings shall be interpreted as illustrative and not in a limiting sense.

I claim:

1. An improved system for effecting the movement of a communications antenna between a first and an operational orientation comprising:

electric motor means including a winding energizable from a source and having a drive output;

drive means coupled for movement in driven relationship with said motor means drive output and in driving relationship with said antenna for selectively moving said antenna between said orientations;

first switch means selectively actuable to alter between first and second circuit conditions;

second switch means selectively actuable to alter between first and second circuit conditions;

switch actuator means configured and arranged for operation in correspondence with said antenna movement between said first and operational orientations, for actuating said first switch means to alter from said first to said second circuit condition when said antenna closely approaches and attains said operational orientation, for actuating said second switch means to alter from said first to said second circuit condition when said antenna closely approaches and attains said first orientation, said first and second switch means first circuit condition permitting an energization of said electric motor means winding, double pole switch means connectable to convey power from said source, manually actuable to assume first and second circuit conditions and coupled for selective circuit completing relationships with said motor means winding through said first and second switch means, said double pole switch means being arranged for effecting conveyance, when in said first circuit condition, of current from said source to energize said winding in one polar sense through said first switch means when said first switch means is in said first circuit condition to effect movement of said antenna toward said operational orientation and, being arranged for effecting conveyance, when in said second circuit condition, of current from said source to energize said winding in another polar sense through said second switch means when said second switch means is in said first circuit condition to effect movement of said antenna toward said first orientation, and first status indicator means having a visually perceptible state when energized, and arranged for energization from said source through a circuit including said winding and said double pole switch means when in said first circuit condition and when said first switch means is in said second circuit condition.

2. The improved system of claim 1 in which:

each said first and second switch means is a single pole switch normally closed to define said first circuit condition; and said double pole switch means is a double pole double throw switch.

3. The improved system of claim 1 in which said first status indicator means comprises a light emitting diode and impedance means said impedance means being selected for so substantially limiting the flow of current through said winding as to prevent the development of a said drive output by said electric motor means.

4. The improved system of claim 1 including second status indicator means having a visually perceptible state when energized, and arranged for energization from said source through a circuit including said field winding and said double pole switch means when in said second circuit condition and when said second switch means is in said second circuit condition.

5. The improved system of claim 4 in which said second status indicator means comprises a light emitting diode and impedance means said impedance means being selected for so substantially limiting the flow of current through said winding as to prevent the development of a said drive output by said electric motor means.

6. The improved system of claim 4 in which each said first and second status indicator means comprises a light emitting diode and said impedance means being selected for so substantially limiting the flow of current through said winding as to prevent the development of a said drive output by said electric motor means.

7. An improved system for effecting the movement of a communications antenna between a first and an operational orientation comprising:

electric motor means including a winding energizable from a source and having a drive output;

a drive shaft fixed to said antenna and rotatable to move the said antenna between said first and operational orientations;

gear means, rotatable with respect to said drive shaft and coupled in driven relationship with said electric motor means drive output;

means defining a friction coupling intermediate said gear means and said drive shaft, said friction coupling being configured to transmit rotational drive from said gear means to said drive shaft and to permit non-destructive relative motion of said antenna and said drive shaft with respect to said gear means upon the application of an external rotation inducing force to said antenna, which force equals or exceeds a predetermined value, first switch means selectively actuable to alter between first and second circuit conditions;

second switch means selectively actuable between first and second circuit conditions;

switch actuator means connected in driven relationship with said drive shaft for operation in correspondence with said antenna movement between said first and operational orientations, for actuating said first switch means to alter from said first to said second circuit condition when said antenna closely approaches and attains said operational orientation, for actuating said second switch means to alter from said first to said second circuit condition when said antenna closely approaches and attains said first orientation, said first and second switch means first circuit condition permitting an energization of said electric motor means winding, and double pole switch means connectable to convey power from said source, manually actuable to assume first and second circuit conditions and coupled for selective circuit completing relationships with said motor means winding through said first and second switch means, said double pole switch means being arranged for effecting conveyance, when in said first circuit condition, of current from said source to energize said winding in one polar sense through said first switch means when said first switch means is in said first circuit condition to effect movement of said antenna toward said operational orientation and, being arranged for effecting conveyance, when in said second circuit condition, of current from said source to energize said winding in another polar sense through said second switch means when said second switch means is in said first circuit condition to effect movement of said antenna toward said first orientation.

8. The improved system of claim 7 in which said switch actuator means is present as cam means mounted for rotation with said drive shaft and exhibiting a profile portion for effecting said first and second switch means actuation.

9. A vehicle mounted automatic erecting apparatus for arcuately moving the elongate antenna of a radio device between secured and operational orientations comprising:

a housing configured for attachment to said vehicle at a select location, drive shaft means, pivotally mounted upon said housing;

bracket means adjustably fixed to said drive shaft means for supporting said antenna and pivotal with said drive shaft means through a predetermined arc to move said antenna between said secured and operational orientations;

motor means mounted within said housing, having a winding and a drive output having a directional sense corresponding with the direction of current flow through said winding;

coupling means connecting said drive shaft means in driven relationship with said motor means drive output;

first and second switch means selectively actuable to alter between closed and open circuit conditions;

switch actuator means situate within said housing and configured and arranged for operation in correspondence with the pivotal position of said drive shaft means, for actuating said first switch means to alter from said closed to said open circuit condition when said bracket means moves said antenna into said operational orientation, for actuating said second switch means to alter from said closed to said open circuit condition when said bracket means moves said antenna into said secured orientation, said first and second switch means normally assuming said closed circuit condition when said bracket means mounted antenna is away from respective said operational and secured orientations;

double pole switch means mountable at a select location within said vehicle, connectible to convey power from a vehicle mounted source thereof, manually actuable to assume first and second circuit conditions and connectible for selective circuit completing relationships with said motor means winding through said first and second switch means, said double pole switch means being configured and arranged for effecting the conveyance, when in said first circuit condition, of current from said source to energize said winding in one polar sense through said first switch means, when the latter is in said closed circuit condition, to effect the driven movement of said drive shaft means and bracket by said coupling means and motor means, to move said antenna toward said operational orientation, and being configured and arranged for effecting the conveyance when in said second circuit condition, of current from said source to energize said winding in another polar sense through said second switch means, when the latter is in said closed circuit condition, to effect the driven movement of said drive shaft means and bracket by said coupling means and motor means to move said antenna toward said secured orientation; and a first light emitting diode and current limiting resistor means, said diode being mountable at a select location within said vehicle and arranged for energization from said source through a circuit path including said winding and said double pole switch means when in said first circuit condition and only when said first switch means is in said open circuit condition.

10. The apparatus of claim 9 including a second light emitting diode and current limiting resistor means, said diode being arranged for energization from said source through a circuit including said field winding and said double pole switch when in said second circuit condition and only when said second switch means is in said open circuit condition.

* * * * *